US012686932B2

(12) United States Patent
Lee et al.

(10) Patent No.: US 12,686,932 B2
(45) Date of Patent: Jul. 21, 2026

(54) GOLD-DOPED NICKEL NANOCLUSTER, PREPARATION METHOD THEREFOR, AND USE THEREOF

(71) Applicant: Industry-Academic Cooperation Foundation, Yonsei University, Seoul (KR)

(72) Inventors: Dongil Lee, Seoul (KR); Woojun Choi, Seoul (KR); Yongsung Jo, Seoul (KR)

(73) Assignee: Industry-Academic Cooperation Foundation, Yonsei University, Seoul (KR)

( * ) Notice: Subject to any disclaimer, the term of this patent is extended or adjusted under 35 U.S.C. 154(b) by 868 days.

(21) Appl. No.: 18/014,833

(22) PCT Filed: Jul. 9, 2021

(86) PCT No.: PCT/KR2021/008792

§ 371 (c)(1),
(2) Date: Jul. 27, 2023

(87) PCT Pub. No.: WO2022/010306

PCT Pub. Date: Jan. 13, 2022

(65) Prior Publication Data

US 2024/0229262 A1 Jul. 11, 2024

(30) Foreign Application Priority Data

Jul. 9, 2020 (KR) ..... 10-2020-0084523
Jul. 2, 2021 (KR) ..... 10-2021-0087056

(51) Int. Cl.
*C25B 11/075* (2021.01)
*C25B 1/23* (2021.01)

(52) U.S. Cl.
CPC ..... *C25B 11/075* (2021.01); *C25B 1/23* (2021.01)

(58) Field of Classification Search
None
See application file for complete search history.

(56) References Cited

U.S. PATENT DOCUMENTS

2015/0125891 A1 5/2015 Wang et al.
2017/0073825 A1 3/2017 Sugano et al.

FOREIGN PATENT DOCUMENTS

CN 106571474 A 4/2017
CN 108931564 A * 12/2018 ..... B82Y 40/00
CN 108931564 B * 10/2020 ..... B82Y 40/00
(Continued)

OTHER PUBLICATIONS

Kauffman, Douglas R., et al. "Selective electrocatalytic reduction of CO2 into CO at small, thiol-capped Au/Cu nanoparticles." The Journal of Physical Chemistry C 122.49 (2018): 27991-28000. (Year: 2018).*

(Continued)

*Primary Examiner* — Louis J Rufo
(74) *Attorney, Agent, or Firm* — The Webb Law Firm

(57) ABSTRACT

Provided is a gold-doped nickel nanocluster having a specific number of gold atoms, nickel atoms, and organothiol-based ligands. The gold atoms, the nickel atoms, and the organothiol-based ligands are bonded in a specific structure, a method for manufacturing the same, an electrode for converting carbon dioxide including the same, and a method for converting carbon dioxide using the same.

10 Claims, 6 Drawing Sheets

(56) References Cited

FOREIGN PATENT DOCUMENTS

| | | | | | |
|---|---|---|---|---|---|
| JP | H9225317 | A | | 9/1997 | |
| KR | 20210066448 | A | * | 6/2021 | ..... C25B 1/23 |
| KR | 1020210066448 | A | | 6/2021 | |

OTHER PUBLICATIONS

Hao et al., "Tuning the electronic structure of AuNi homogeneous solid-solution alloy with positively charged Ni center for highly selective electrochemical CO2 reduction", Chemical Engineering Journal, 2021, 11 pages, vol. 404.

Kwak et al., "Electrochemistry of Atomically Precise Metal Nanoclusters", Accounts of Chemical Research, 2019, pp. 12-22, vol. 52.

Seong et al., "Transplanting Gold Active Sites into Non-precious-metal Nanoclusters for Efficient CO2-to-CO Electroreduction", Journal of the American Chemical Society, Jan. 2023, pp. 2152-2160, vol. 145.

Zhu et al., "Controllable synthesis and electrocatalytic applications of atomically precise gold nanoclusters", Nanoscale Advances, 2021, pp. 6330-6341, vol. 3.

Kauffman et al., "Selective Electrocatalytic Reduction of CO2 into CO at Small, Thiol-Capped Au/Cu Nanoparticles", The Journal of Physical Chemistry C, 2018, pp. 27991-28000, vol. 122, American Chemical Society.

Pan et al., "Co-synthesis of atomically precise nickel nanoclusters and the pseudo-optical gap Ni4(SR)8", Dalton Trans., 2018, pp. 11097-11103, vol. 47, The Royal Society of Chemistry.

* cited by examiner

GOLD-DOPED NICKEL NANOCLUSTER, PREPARATION METHOD THEREFOR, AND USE THEREOF

CROSS REFERENCE TO RELATED APPLICATIONS

This application is the United States national phase of International Patent Application No. PCT/KR2021/008792 filed Jul. 9, 2021, and claims priority to Korean Patent Application No. 10-2020-0084523 filed Jul. 9, 2020, and Korean Patent Application No. 10-2021-0087056 filed Jul. 2, 2021, the disclosures of which are hereby incorporated by reference in their entireties.

BACKGROUND OF THE INVENTION

Field of the Invention

The present disclosure relates to a gold-doped nickel nanocluster, a method for manufacturing the same, and a use thereof, and more particularly, to a gold-doped nickel nanocluster very useful as a catalyst for carbon dioxide conversion reaction, a method for manufacturing the same, an electrode for converting carbon dioxide including the same, and a method for converting carbon dioxide using the same.

Description of Related Art

Nanoclusters or superatoms composed of a certain number of metal atoms and ligands follow a superatom orbital theory newly defining valence electrons of particles, which is a theory that considers the valence electrons as one superatom.

Nanoclusters are stable compared to single atoms or nanoparticles, and have completely different optical and electrochemical properties from nanoparticles because they have more molecular property than metallic property. In particular, as the optical, electrical, and catalytic properties of nanoclusters are sensitively changed depending on the number of metal atoms, types of metal atoms, ligands, etc., researches on nanoclusters are being actively conducted in a wide variety of fields.

Meanwhile, as the use of fossil fuels increases due to population growth and industrialization since the Industrial Revolution, greenhouse gas emissions increase and greenhouse gas concentrations in the atmosphere increase, resulting in global warming in which the average temperature of the earth rises. As a result, efforts are being made to reduce carbon dioxide emissions through the 2015 Paris Agreement on Climate Change.

Among them, carbon dioxide conversion technology through electrochemical reduction is a technology that reduces carbon dioxide to a useful carbon compound through the movement of electrons by inputting electrical energy to generate a potential difference between electrodes. The carbon dioxide conversion technology has advantages of performing the carbon dioxide reduction reaction even at room temperature and pressure conditions, not discharging chemicals by recycling an electrolyte since raw materials required for the reaction are only water and carbon dioxide, and making processes simple.

However, in the case of the electrochemical technology, as it is greatly influenced by the reaction conditions such as the type of electrode catalyst, the nature of the electrolyte, pH, temperature, pressure, etc., in order to reduce carbon dioxide and convert the carbon dioxide into a useful carbon compound, in particular, researches on the type of electrode catalyst and the electrolyte used are required.

Currently, a gold catalyst is mainly used as the electrode catalyst, but the gold catalyst is expensive and has limited reserves, so there is a need for a catalyst that may replace the gold catalyst.

In addition, in the case of the conventional carbon dioxide electrochemical reduction technology, as the carbon dioxide reduction reaction is performed in an aqueous electrolyte solution, there is a problem in that selectivity for carbon dioxide reduction is low because solubility of carbon dioxide is low and reduction potential regions of hydrogen and carbon dioxide generated from the aqueous solution are similar.

Therefore, there is a need to develop an excellent catalyst that suppresses a hydrogen generation reaction which is the competing reaction, and has excellent selectivity for the carbon dioxide reduction reaction.

SUMMARY OF THE INVENTION

Technical Problem

An object of the present disclosure provides a gold-doped nickel nanocluster with excellent stability, low price and surprisingly improved carbon dioxide conversion reaction selectivity, and a method for manufacturing the same.

Another object of the present disclosure provides an electrode for converting carbon dioxide containing a gold-doped nickel nanocluster of the present disclosure and a method for converting carbon dioxide using the same.

Technical Solution

The present disclosure is to provide a gold-doped nickel nanocluster that may be used as a catalyst having excellent selectivity for carbon dioxide conversion reaction. The gold-doped nickel nanocluster satisfies Formula 1 below.

[Formula 1]

$$Au_xNi_y(SR)_z$$

(In the above Formula 1, SR is an organothiol-based ligand; x is 2 or 4, y is 2 to 4, z is 8 or 10, and x+y=5 or 6 is satisfied.)

Preferably, according to an embodiment of the present disclosure, the gold-doped nickel nanocluster may be $Au_2Ni_3(SR)_8$, $Au_4Ni_2(SR)_8$ or $Au_2Ni_4(SR_{10}$. In the above Formula 1, the organothiol ligand may be any one or two or more selected from (C1-C30)alkanethiol, (C6-C30) arylthiol, (C3-C30)cycloalkanethiol, (C5-C30) heteroarylthiol, (C3-C30) heterocycloalkanethiol, and (C1-C30) aryl(C1-C30)alkanethiol.

According to the embodiment of the present disclosure, the gold-doped nickel nanocluster may be a catalyst for carbon dioxide conversion reaction.

In addition, the present disclosure provides a method for manufacturing the gold-doped nickel nanocluster of the present disclosure. The method for manufacturing a gold-doped nickel nanocluster includes the steps of:

step a) preparing a reaction solution by mixing a nickel precursor and a gold precursor in the presence of a solvent; and step b) adding an organothiol-based ligand compound and a reducing agent to the reaction solution to synthesize a gold-doped nickel nanocluster satisfying Formula 1 below.

[Formula 1]

$$Au_xNi_y(SR)_z$$

(In the above Formula 1, SR is an organothiol-based ligand; x is 2 or 4, y is 2 to 4, z is 8 or 10, and x+y=5 or 6 is satisfied.)

Preferably, according to an embodiment of the present disclosure, the nickel precursor may be used in 1.5 to 2.5 moles based on 1 mole of the gold precursor.

Preferably, according to an embodiment of the present disclosure, the nickel precursor may be any one or two or more selected from $Ni(NO_3)_2$, $NiCl_2$, $NiSO_4$ and $Ni(C_5H_7O_2)_2$, the gold precursor may be any one or two or more selected from $HAuCl_4$, triphenylphosphine gold (I) chloride ($AuPPh_3Cl$), $AuCl_3$, $KAuCl_4$ $Au(OH)_3$ and hydrates thereof, and the reducing agent may be one or two or more selected from triethylamine, oleylamine, carbon monoxide, and sodium borohydride.

In addition, the present disclosure provides an electrode for carbon dioxide conversion reaction including the gold-doped nickel nanocluster of the present disclosure.

In addition, the present disclosure provides a method for converting carbon dioxide including reducing carbon dioxide from an aqueous solution containing carbon dioxide using the electrode for carbon dioxide conversion reaction of the present disclosure.

Advantageous Effects

The gold-doped nickel nanocluster of the present disclosure contains a specific number of atoms and organothiol-based ligands, specifically, two gold atoms, three nickel atoms, and eight organothiol-based ligands, four gold atoms, two nickel atoms, and eight organothiol-based ligands, or two gold atoms, four nickel atoms, and ten organothiol-based ligands that are bonded in a specific structure, so the gold-doped nickel nanocluster may have excellent activity for a conversion reaction of carbon dioxide in solutions of all acidities, have excellent stability compared to the conventional gold (Au)-based catalysts, and is very useful for a catalyst for alkaline water electrolysis because of its low price and excellent uniformity.

In addition, the method for manufacturing a gold-doped nickel nanocluster according to the present disclosure may control molarities of a nickel precursor and a gold precursor to effectively synthesize the gold-doped nickel nanocluster in which a specific number of gold atoms, nickel atoms, and organothiol-based ligands are bonded in a specific structure.

The present disclosure has the advantage of providing a gold-doped nickel nanocluster as a catalyst for carbon dioxide conversion reaction having the above effect.

In addition, the electrode for carbon dioxide conversion reaction including the gold-doped nickel nanocluster of the present disclosure may convert carbon dioxide into carbon monoxide with high selectivity in an aqueous solution containing carbon dioxide.

Therefore, the electrode for carbon dioxide conversion reaction of the present disclosure may effectively convert carbon dioxide with high selectivity and conversion rate in an aqueous solution containing carbon dioxide.

DESCRIPTION OF THE INVENTION

Figure 1:
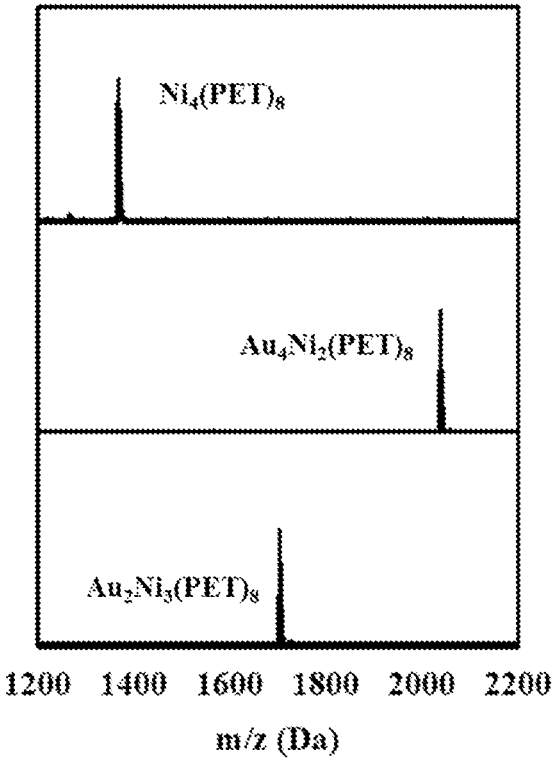
FIG. 1 is electrospray ionization mass spectrometry data of $Au_4Ni_2(PET)_8$, $Au_2Ni_3(PET)_8$, and $Ni_4(PET)_8$ nanoclusters prepared in Examples and Comparative Examples of the present disclosure.

Hereinafter, a gold-doped nickel nanocluster manufacturing method, a method for manufacturing the same, an electrode for carbon dioxide conversion reaction including the same, and a method for converting carbon dioxide using the same will be described in detail with reference to the accompanying drawings. The drawings to be provided below are provided by way of example so that the spirit of the present disclosure can be sufficiently transferred to those skilled in the art. Therefore, the present disclosure is not limited to the accompanying drawings provided below, but may be modified in many different forms. In addition, the accompanying drawings suggested below will be exaggerated in order to clear the spirit and scope of the present disclosure.

Technical terms and scientific terms used in the present specification have the general meaning understood by those skilled in the art to which the present disclosure pertains unless otherwise defined, and a description for the known function and configuration unnecessarily obscuring the gist of the present disclosure will be omitted in the following description and the accompanying drawings.

In addition, terms first, second, A, B, (a), (b), and the like, will be used in describing components of the present disclosure. These terms are used only in order to distinguish any component from other components, and features, sequences, or the like, of corresponding components are not limited by these terms.

Carbon dioxide conversion technology through electrochemical reduction proceeds as in Scheme below, and a carbon dioxide reduction reaction is performed in an aqueous electrolytic solution. As reduction potential regions of hydrogen and carbon dioxide generated from the aqueous solution are similar, there is a problem in that selectivity for carbon dioxide reduction is low.

[Scheme]

$$CO_2 + e^- + H_2O \longrightarrow COOH^+ + OH^- \quad 120\ mV\ dec^{-1}$$

$$COOH^+ + e^- \longrightarrow CO^+ + OH^- \quad 40\ mV\ dec^{-1}$$

$$CO^+ \longrightarrow CO \quad 30\ mV\ dec^{-1}$$

In addition, a gold catalyst is mainly used as the electrode catalyst, but the gold catalyst is expensive and has limited reserves, so there is a need for a catalyst that may replace the gold catalyst.

Accordingly, as a result of intensifying researches, the present inventors have found that the gold-doped nickel nanocluster is inexpensive, has excellent uniformity, and has excellent selectivity for carbon dioxide reduction, thereby completing the present disclosure.

Specifically, the present disclosure provides a gold-doped nickel nanocluster that satisfies Formula 1 below.

[Formula 1]

$$Au_xNi_y(SR)_z$$

(In the above Formula 1, SR is an organothiol-based ligand; x is 2 or 4, y is 2 to 4, z is 8 or 10, and x+y=5 or 6 is satisfied.)

The gold-doped nickel nanocluster of the present disclosure has a specific number of gold atoms, nickel atoms, and organothiol-based ligands that satisfy the above Formula 1, and has excellent stability and uniformity compared to the conventional metal catalysts and is very economical by bonding the gold atoms, the nickel atoms, and the organothiol-based ligands in a specific structure.

Furthermore, the gold-doped nickel nanocluster of the present disclosure is very useful as a catalyst for carbon dioxide conversion reaction because of its surprisingly excellent selectivity in the carbon dioxide conversion reaction.

Preferably, the gold-doped nickel nanocluster of the present disclosure may be $Au_2Ni_3(SR)_8$, $Au_4Ni_2(SR)_8$ or $Au_2Ni_4(SR)_{10}$.

That is, preferably, the gold-doped nickel nanocluster according to an embodiment of the present disclosure has surprisingly improved selectivity in the carbon dioxide conversion reaction by bonding two gold atoms and three nickel atoms or four gold atoms and two nickel atoms to eight organothiol-based ligands in a specific structure, or bonding two gold atoms and four nickel atoms to ten organothiol-based ligands in a specific structure.

SR, which is an organothiol-based ligand according to an embodiment of the present disclosure, may be any one or two or more selected from alkanethiols having 1 to 30 carbon atoms, arylthiol having 6 to 30 carbon atoms, cycloalkanethiols having 3 to 30 carbon atoms, heteroarylthiols having 5 to 30 carbon atoms, heterocycloalkanethiols having 3 to 30 carbon atoms, and arylalkanethiols having 6 to 30 carbon atoms. In the organothiol-based ligand, one or more hydrogens in a functional group may be further substituted with a substituent or may not be substituted with the substituent. In this case, the substituent may be an alkyl group having 1 to 10 carbon atoms, a halogen group (—F, —Br, —Cl, —I), a nitro group, a cyano group, a hydroxy group, an amino group, an aryl group having 6 to 20 carbon atoms, an alkenyl group having 2 to 7 carbon atoms, a cycloalkyl group having 3 to 20 carbon atoms, a heterocycloalkyl group having 3 to 20 carbon atoms, or a heteroaryl group having 4 to 20 carbon atoms. However, the carbon atoms of the organothiol-based ligand described above does not include the carbon atoms of the substituent. In addition, in all functional groups including the alkyl group, the alkyl group may be a linear or branched type.

More specific examples of the organothiol-based ligand may include any one or two or more selected from the group consisting of pentanethiol, hexanethiol, heptanethiol, 2,4-dimethylbenzenethiol, 2-phenylethanethiol, glutathione, thiopronin, thiolated poly(ethylene glycol), p-mercaptophenol, (r-mercaptopropyl)-trimethoxysilane, etc., but are not limited thereto.

The organothiol-based ligand of the present disclosure may be preferably (C6-C12)aryl(C1-C10) alkylthiol, and more preferably phenyl(C1-$C_6$)alkylthiol. Examples of the organothiol-based ligand may be phenylmethylthiol, phenylethylthiol, 2-phenylethylthiol, 1-phenylpropylthiol, 2-phenylpropylthiol, or 3-phenylpropylthiol, but are not limited thereto.

In addition, the present disclosure relates to an electrode for carbon dioxide conversion reaction including, as a catalyst, the gold-doped nickel nanocluster satisfying Formula 1 according to an embodiment of the present disclosure, in which the electrode for carbon dioxide conversion reaction may be used an electrode for carbon dioxide reduction reaction. More specifically, the electrode for carbon dioxide conversion reaction may include, as the catalyst, the gold-doped nickel nanocluster satisfying the above Formula 1, a conductive material, a polymer binder, etc.

In an embodiment of the present disclosure, the conductive material may be a carbon body, but may be used without particular limitation as long as it is commonly used in the art. Specific examples of the carbon body may include any one or two or more selected from the group consisting of carbon black, super-p, activated carbon, hard carbon, soft carbon, etc., but are not limited thereto.

In an embodiment of the present disclosure, the polymer binder is used for firmly fixing the gold-doped nickel nanocluster, which is the catalyst for carbon dioxide conversion reaction, and the conductive material, and may be used without particular limitation as long as it is commonly used in the art. Specific examples of the polymer binder may include polytetrafluoroethylene (PTFE) or the like. The addition amount of the polymer binder is not particularly limited as long as the gold-doped nickel nanocluster for the carbon dioxide conversion reaction and the conductive material are firmly fixed.

In addition, the present disclosure provides a method for converting carbon dioxide including reducing carbon dioxide from an aqueous solution containing carbon dioxide using the electrode for carbon dioxide conversion reaction of the present disclosure.

In the method for converting carbon dioxide according to the embodiment of the present disclosure, by using the electrode for carbon dioxide conversion reaction of the present disclosure having high activity in the carbon dioxide conversion reaction, carbon dioxide is reduced and carbon monoxide is generated with excellent selectivity.

Therefore, the electrode for carbon dioxide conversion reaction of the present disclosure may effectively convert carbon dioxide, which affects the greenhouse effect, into carbon monoxide which is a useful gas.

Another aspect of the present disclosure relates to a method for manufacturing a gold-doped nickel nanocluster including a) preparing a reaction solution by mixing a nickel precursor and a gold precursor in the presence of a solvent, and b) adding an organothiol-based ligand compound and a reducing agent to the reaction solution to synthesize a gold-doped nickel nanocluster satisfying Formula 1 below.

[Formula 1]

$$Au_xNi_y(SR)_z$$

(In the above Formula 1, SR is an organothiol-based ligand; x is 2 or 4, y is 2 to 4, z is 8 or 10, and x+y=5 or 6 is satisfied.)

By manufacturing the gold-doped nickel nanocluster for carbon dioxide conversion reaction that satisfies Formula 1 through this method, not only is excellent in the activity for the carbon dioxide conversion reaction in solutions of all acidities, but it is also cheaper and has more excellent uniformity than the conventional catalysts, so the gold-doped nickel nanocluster may be usefully used as a catalyst for carbon dioxide conversion reaction.

More preferably, the method for manufacturing a gold-doped nickel nanocluster may control the molarities of the nickel precursor and the gold precursor, control an addition time of the reducing agent added, and use a specific solvent to effectively synthesize the gold-doped nickel nanocluster in which a specific number of gold atoms, nickel atoms, and organothiol-based ligands are bonded in a specific structure, thereby obtaining the advantage of providing the gold-doped nickel nanocluster for carbon dioxide conversion reaction having the above effect.

Hereinafter, each step of the method for manufacturing a gold-doped nickel nanocluster catalyst for carbon dioxide conversion reaction that satisfies Formula 1 will be described in detail.

First, step a) preparing of the reaction solution by reacting the nickel precursor and the gold precursor in the presence of the solvent may be performed.

As described above, it is very important to appropriately control the molar concentration ratio of the nickel precursor and the gold precursor. As a preferred example, regarding the molar concentration ratio of the nickel precursor and the gold precursor, the nickel precursor may be used in an amount of 1.5 to 2.5 moles, preferably 1.8 to 2.3 moles, and more preferably 1.9 to 2.2 moles, based on 1 mole of the gold precursor. In this range, it may be possible to synthesize the gold-doped nickel nanocluster that satisfies Formula 1.

Meanwhile, in an example of the present disclosure, the nickel precursor may be used without particular limitation as long as it is commonly used in the art, and as specific examples, by using any one or two or more selected from $NiCl_2$, $Ni(NO_3)_2$, $NiSO_4$ and $Ni(C_5H_7O_2)_2$ and preferably, $Ni(NO_3)_2$, it is possible to improve the synthesis efficiency.

The gold precursor is also not particularly limited as long as it is commonly used in the art, and as specific examples, any one or two or more selected from $HAuCl_4$, triphenylphosphine gold (I) chloride ($AuPPh_3Cl$), $AuCl_3$, $KAuCl_4$, $Au(OH)_3$ and hydrates thereof may be used, and preferably, $HAuCl_4$ may be used.

In addition, as described above, the proper selection of the solvent used may also be very important. As a preferred example, the solvent may be a polar aprotic solvent, and as a more specific example, any one or two or more selected from the group consisting of dimethylformamide (DMF), acetonitrile, and dimethyl sulfoxide (DMSO) may be used.

Next, step b) adding of the organothiol-based ligand compound and the reducing agent to the reaction solution to synthesize the gold-doped nickel nanocluster satisfying Formula 1 below may be performed.

In this case, it is preferable to quickly add the reducing agent after adding the organothiol-based ligand compound. That is, it is preferable to add the reducing agent at once after constantly adding the organothiol-based ligand compound to the reaction solution. Specifically, after the organothiol-based ligand compound is constantly added for 2 to 5 minutes and stirred for 10 to 20 minutes, the reducing agent is rapidly added. This may reduce side reactions and increase reaction efficiency.

According to an embodiment of the present disclosure, the organothiol-based ligand compound may be RSH, which is a compound before hydrogen is reduced, compared to SR. A specific example of the organothiol-based ligand compound may include any one or two or more selected from the group consisting of alkanethiols having 1 to 30 carbon atoms, arylthiol having 6 to 30 carbon atoms, cycloalkanethiols having 3 to 30 carbon atoms, heteroarylthiols having 5 to 30 carbon atoms, heterocycloalkanethiols having 3 to 30 carbon atoms, and arylalkanethiols having 6 to 30 carbon atoms, and in the organothiol-based ligand, one or more hydrogens in a functional group may be further substituted with a substituent or may not be substituted with the substituent. In this case, the substituent may be an alkyl group having 1 to 10 carbon atoms, a halogen group (—F, —Br, —Cl, —I), a nitro group, a cyano group, a hydroxy group, an amino group, an aryl group having 6 to 20 carbon atoms, an alkenyl group having 2 to 7 carbon atoms, a cycloalkyl group having 3 to 20 carbon atoms, a heterocycloalkyl group having 3 to 20 carbon atoms, or a heteroaryl group having 4 to 20 carbon atoms. However, the carbon atoms of the organothiol-based ligand described above do not include the carbon atoms of the substituent. In addition, in all functional groups including the alkyl group, the alkyl group may have a linear or branched type.

More specific examples of the organothiol-based ligand may include any one or two or more selected from the group consisting of pentanethiol, hexanethiol, heptanethiol, 2,4-dimethylbenzenethiol, 2-phenylethanethiol, glutathione, thiopronin, thiolated poly(ethylene glycol), p-mercaptophenol, (r-mercaptopropyl)-trimethoxysilane, etc., but are not limited thereto.

Preferably, the organothiol-based ligand of the present disclosure may be preferably (C6-C12) aryl(C1-C10)alkylthiol, and more preferably phenyl(C1-$C_6$)alkylthiol. Examples of the organothiol-based ligand may be phenylmethylthiol, phenylethylthiol, 2-phenylethylthiol, 1-phenylpropylthiol, 2-phenylpropylthiol, 3-phenylpropylthiol, pentylthiol, or hexylthiolyl, but are not limited thereto.

In one example of the present disclosure, the mixing ratio of the nickel precursor and the organothiol-based ligand compound may be the conventional mixing ratio in the art, and as a specific example, the molar ratio of the nickel precursor and the organothiol-based ligand compound is 1:1 to 15, more preferably 1:1.5 to 10, and more preferably 1:2 to 5. In this range, it is good that the reaction impurities may be reduced while the synthesis efficiency is excellent.

In one example of the present disclosure, the reducing agent may be used without particular limitation as long as it is commonly used in the art, and specific examples of the reducing agent may include one or two or more selected from triethylamine, oleylamine, carbon monoxide, and sodium borohydride may be used, and preferably include one or two or more selected from triethylamine and sodium borohydride.

In addition, the reducing agent may be added in an amount of 5 to 30 mmol based on 1 mmol of the nickel precursor, but this is only an example and the present disclosure is not limited thereto.

In addition, after the completion of the reaction in step b), an additional purification process may be further performed to obtain a high-purity gold-doped nickel nanocluster, and the additional purification process may be performed through the conventional method.

In addition, the gold-doped nickel nanocluster for carbon dioxide conversion reaction of the present disclosure has very high selectivity for the carbon dioxide conversion reaction.

Hereinafter, the gold-doped nickel nanocluster, which is very useful as the catalyst for carbon dioxide conversion reaction according to the present disclosure, and the manufacturing method thereof will be described in more detail through examples. However, the following Inventive Examples are only one reference example for describing the present disclosure in detail, and the present disclosure is not limited thereto and may be implemented in various forms.

In addition, unless otherwise defined, all technical and scientific terms have the same meaning as commonly understood by one of ordinary skill in the art to which this invention pertains. The terms used in the description herein are for the purpose of effectively describing particular embodiments only and are not intended to limit the invention. In addition, the unit of additives not specifically described in the specification may be wt %.

[Example 1] Synthesis of Gold-Doped Nickel Nanocluster

After 0.42 mmol of $Ni(NO_3)_2$ and 0.21 mmol of $HAuCl_4$ were dissolved in 6 mL of acetonitrile (MeCN), the mixture was stirred for 20 minutes.

Thereafter, 1.40 mmol of 2-phenylethanethiol ($PhC_2H_4SH$) was added for 2 minutes, and then stirred for 15 minutes, and 3.6 mmol of triethylamine ($NEt_3$) was added thereto. The reaction was completed by further stirring for 3 hours.

When the reaction was completed, the reaction mixture was washed with pure water and methanol to remove impurities, filtered, separated into plate TLC (dichloromethane: n-hexane), and then recrystallized into dichloromethane and methanol to obtain $Au_2Ni_4$ (PET=2-phenylethanethiol)$_{10}$, $Au_4Ni_2(PET)_8$, and $Au_2Ni_3(PET)_8$, which are the high-purity gold-doped nickel nanocluster, respectively.

[Comparative Example 1] Synthesis of $Ni_4(PET)_8$

High-purity $Ni_4(PET)_8$ was obtained in the same manner as in Example 1, except that the gold precursor was not used in Example 1.

Example 2

23 μg of each of the $Au_2Ni_4(PET)_{10}$, $Au_4Ni_2(PET)_8$, and $Au_2Ni_3(PET)_8$ nanoclusters prepared in Example 1 was dissolved in dichloromethane (DCM) and added to 40 μl of acetone, and then subjected to ultrasonic dispersion for about 1 minute to prepare a nanocluster composite dispersion.

Next, the prepared nanocluster composite dispersion was solution-deposited on a gas diffusion microporous carbon electrode (Effects of gas diffusion layer (GDL) and micro porous layer (MPL); GDE) having an area of 1 $cm^2$ to prepare $Au_2Ni_4(PET)_{10}$ (denoted as $Au_2Ni_4$), $Au_4Ni_2(PET)_8$ (denoted as $Au_4Ni_2$), and $Au_2Ni_3(PET)_8$ (denoted as $Au_4Ni_2$) which are a nanocluster composite film.

Comparative Example 2

Comparative Example 2 was prepared in the same manner as in Example 2, except that $Ni_4(PET)_8$ prepared in Comparative Example 1 was used instead of the gold-doped nickel nanocluster prepared in Example 1.

[Result Analysis]

1) Synthesis Confirmation

FIG. 1 illustrates electrospray ionization mass spectrometry data of $Au_4Ni_2(PET)_8$, $Au_2Ni_4(PET)_{10}$, $Au_2Ni_3(PET)_8$, and $Ni_4(PET)_8$, and it was confirmed that the $Au_4Ni_2(PET)_8$, $Au_2Ni_4(PET)_{10}$, $Au_2Ni_3(PET)_8$, and $Ni_4(PET)_8$ nanoclusters prepared in Example 1 and Comparative Example 1, respectively, were well synthesized with a single composition and high purity.

Figure 2:
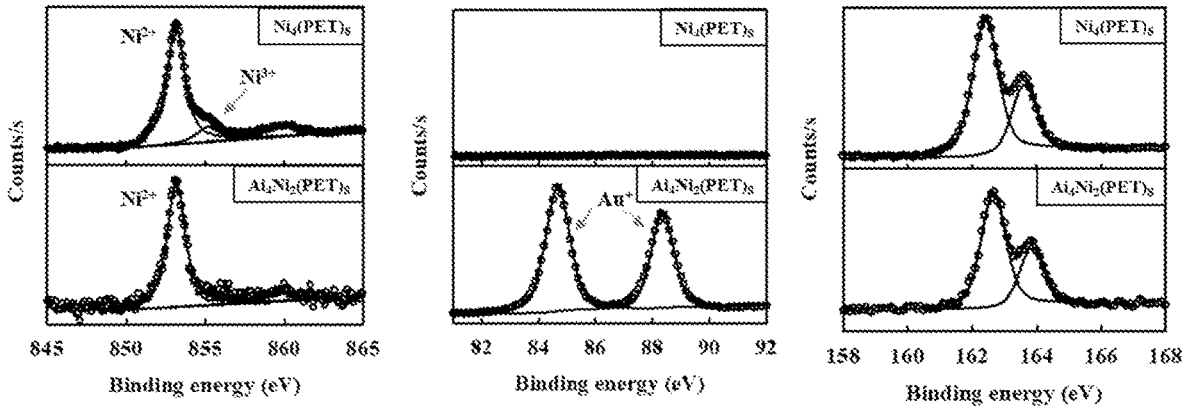
FIG. 2 is a graph illustrating results of analyzing components through X-ray photoelectron spectroscopy (XPS) of $Au_4Ni_2(PET)_8$ nanoclusters prepared in an embodiment of the present disclosure.

FIG. 2 illustrates results of analyzing components through X-ray photoelectron spectroscopy (XPS) of $Au_4Ni_2(PET)_8$ prepared in an embodiment of the present disclosure.

As suggested in FIG. 2, it was confirmed that Ni in $Au_4Ni_2(PET)_8$ exists in a $Ni^{2+}$ state and Au exists in an Au+ state, and the compositions of each element are Ni:Au:S=2:4.4:8.2, which was confirmed to be consistent with the composition of $Au_4Ni_2(PET)_8$.

2) UV-IR Absorption Spectrum

Figure 3:
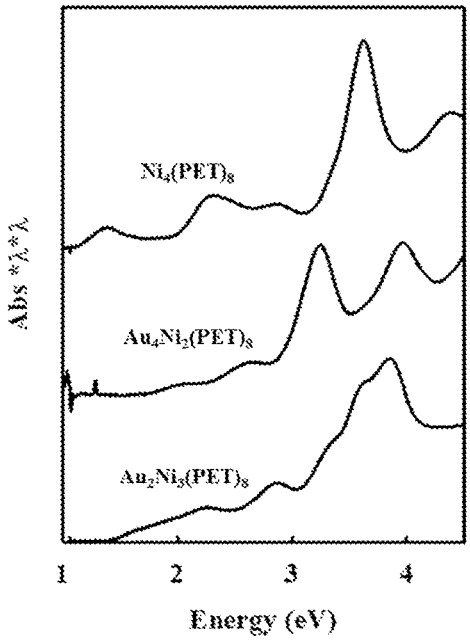
FIGS. 3 and 4 are ultraviolet-visible-near-infrared absorption spectrum of $Au_4Ni_2(PET)_8$, $Au_2Ni_4(PET)_{10}$, $Au_2Ni_3(PET)_8$, $Ni_4(PET)_8$ and $Ni_5(PET)_{10}$ nanoclusters prepared in Examples and Comparative Examples of the present disclosure.
Figure 4:
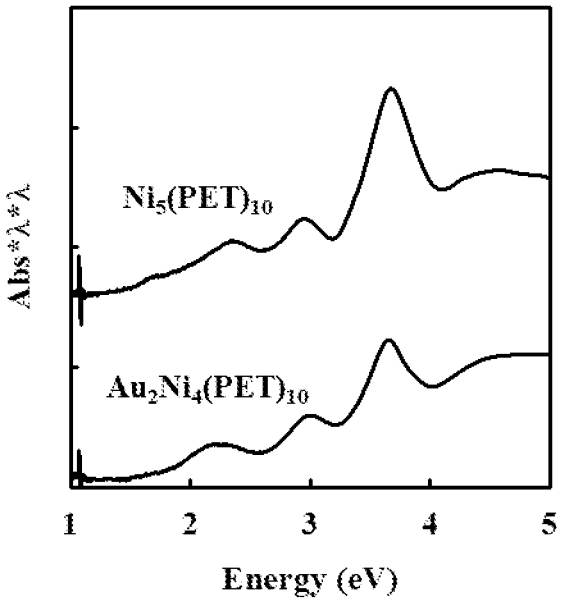

FIGS. 3 and 4 illustrate ultraviolet-visible-near-infrared absorption spectrum measurement results of $Au_4Ni_2(PET)_8$, $Au_2Ni_4(PET)_{10}$, $Au_2Ni_3(PET)_8$, and $Ni_4(PET)_8$ nanoclusters. In the UV-Vis absorption graph of FIG. 3, new peaks of $Au_4Ni_2(PET)_8$ and $Au_2Ni_3(PET)_8$, which are different from $Ni_4(PET)_8$, were observed. In the UV-Vis absorption graph of FIG. 4, it was confirmed that $Au_2Ni_4(PET)_{10}$ moved toward lower energy compared to $Ni_5(PET)_{10}$.

3) Confirmation of Gold-Doped Nickel Nanocluster Catalytic Activity

Figure 5:
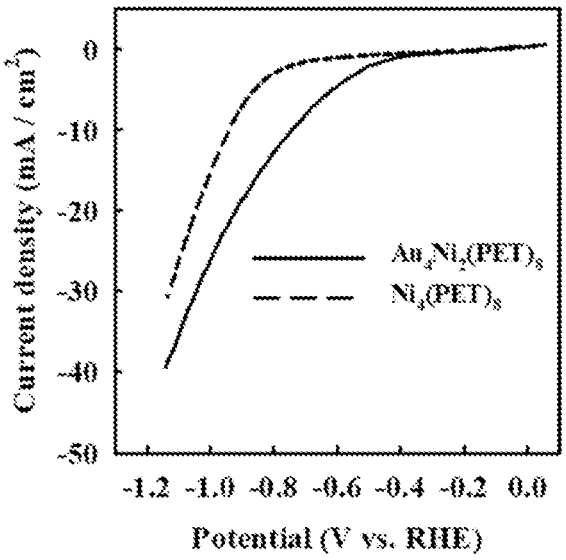
FIG. 5 is a linear scanning potential method analysis data for catalytic activity of $Au_4Ni_2(PET)_8$ and $Ni_4(PET)_8$ nanocluster electrodes.

FIG. 5 is a linear scanning potential method analysis data for catalytic activity of $Au_4Ni_2(PET)_8$ and $Ni_4(PET)_8$ nanocluster electrodes.

As suggested in FIG. 5, the voltage of the $Au_4Ni_2(PET)_8$ nanocluster electrode prepared in Example of the present disclosure is advanced compared to the $Ni_4(PET)_8$ prepared in Comparative Example 1, so it can be seen that the carbon dioxide conversion reaction occurs more quickly.

Figure 6:
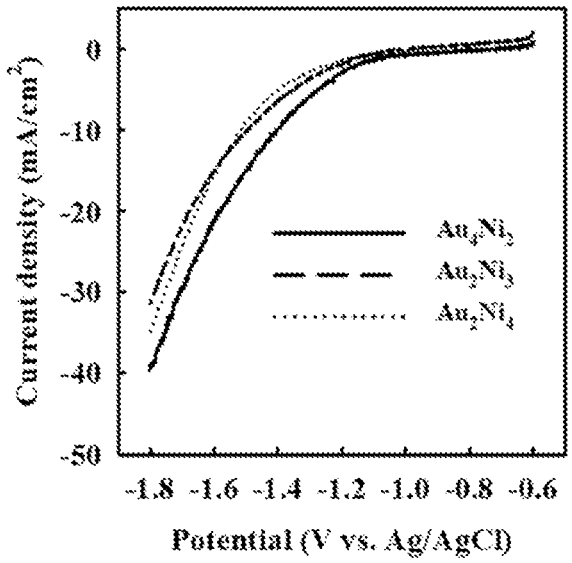
FIG. 6 is linear scanning potential method analysis data for the catalytic activity of $Au_4Ni_2(PET)_8$ (denoted as $Au_4Ni_2$), $Au_2Ni_4(PET)_{10}$ (denoted as $Au_2Ni_4$), and $Au_2Ni_3(PET)_8$ (denoted as $Au_2Ni_3$) nanocluster electrodes.

FIG. 6 is linear scanning potential method analysis data for the catalytic activity of $Au_4Ni_2(PET)_8$ (denoted as $Au_4Ni_2$), $Au_2Ni_4(PET)_{10}$ (denoted as $Au_2Ni_4$), and $Au_2Ni_3(PET)_8$ (denoted as $Au_2Ni_3$) nanocluster electrodes. As illustrated in FIG. 6, it can be seen that $Au_4Ni_2(PET)_8$ has the largest current value, and thus carbon dioxide is converted the most.

Figure 7:
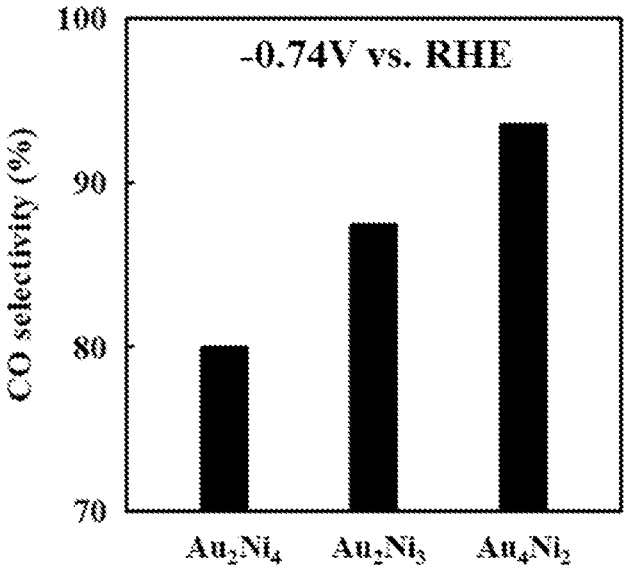
FIG. 7 is a graph showing carbon dioxide selectivity of $Au_4Ni_2(PET)_8$ (denoted as $Au_4Ni_2$), $Au_2Ni_4(PET)_{10}$ (denoted as $Au_2Ni_4$), and $Au_2Ni_3(PET)_8$ (denoted as $Au_2Ni_3$) nanocluster electrodes.

FIG. 7 is a graph showing selectivity of $Au_4Ni_2(PET)_8$ (denoted as $Au_4Ni_2$), $Au_2Ni_4(PET)_{10}$ (denoted as $Au_2Ni_4$), and $Au_2Ni_3(PET)_8$ (denoted as $Au_2Ni_3$) nanocluster electrodes.

Looking at the graph of FIG. 7, it can be seen that $Au_4Ni_2(PET)_8$ shows the highest reaction selectivity among gold-doped nickel nanoclusters at −0.74V based on a reversible hydrogen electrode (RHE).

Figure 8:
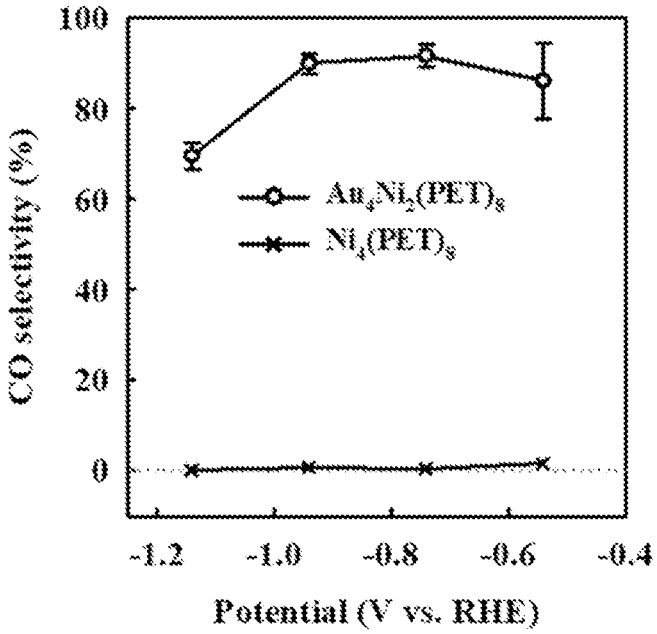
FIG. 8 is a graph of carbon dioxide selectivity of $Au_4Ni_2(PET)_{10}$ and $Ni_4(PET)_8$ nanocluster electrodes.
Figure 9:
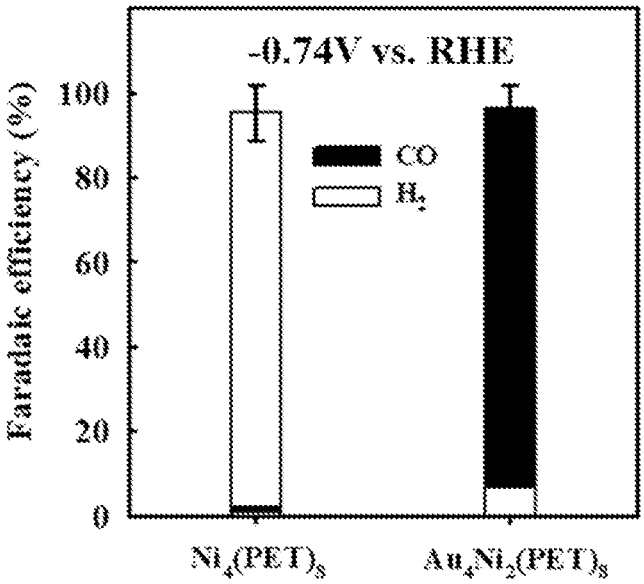
FIG. 9 is a graph of Faradaic efficiency of $Au_4Ni_2(PET)_8$ and $Ni_4(PET)_8$ nanocluster electrodes.

FIG. 8 is a graph showing the selectivity of $Au_4Ni_2(PET)_8$ and $Ni_4(PET)_8$ nanocluster electrodes, and FIG. 9 is a graph showing a Faradaic efficiency. It can be seen from the graphs of FIGS. 8 and 9 that, in the case of $Ni_4(PET)_8$, almost no carbon monoxide is produced and hydrogen is mostly generated, whereas in the case of the $Au_4Ni_2(PET)_8$ cluster which is the example of the present disclosure, more than 90% of carbon monoxide is generated and thus, the example $Au_4Ni_2(PET)_8$ cluster, which is the example of the present disclosure, has high selectivity.

Figure 10:
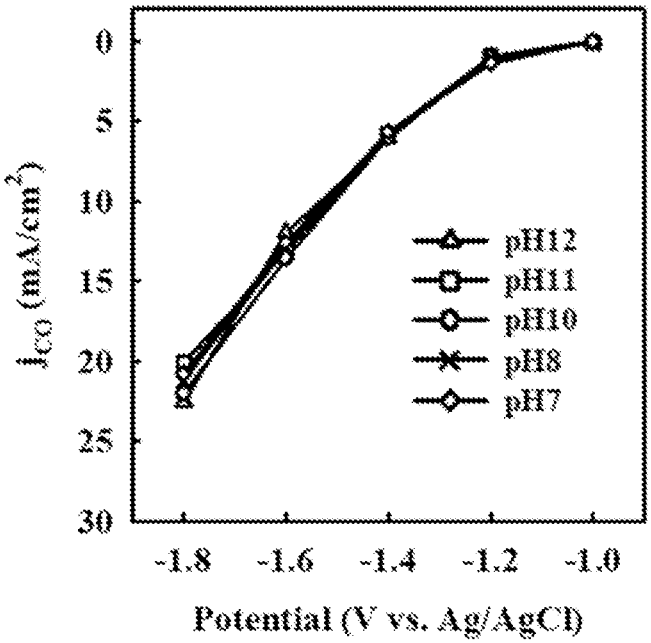
FIG. 10 is constant voltage test analysis data for catalytic activity according to acidity of a solution of the $Au_4Ni_2(PET)_8$ nanocluster electrode based on the acidity of the solution.

FIG. 10 is data analyzing the catalytic activity of $Au_4Ni_2(PET)_8$ nanoclusters according to the acidity of the solution. As illustrated in FIG. 10, it was confirmed that $Au_4Ni_2(PET)_8$ nanoclusters had a constant current value in solutions of all acidities.

In addition, it was confirmed that constant voltage electrolysis was performed to confirm the stability of $Au_4Ni_2(PET)_8$, a current was maintained for 25 hours, and the selectivity of carbon monoxide was maintained at 90% or more. That is, when the change of the $Au_4Ni_2(PET)_8$ catalyst before and after the constant voltage electrolysis was confirmed with a transmission electron microscope, it was confirmed that the $Au_4Ni_2(PET)_8$ catalyst was well maintained without change, so it can be seen that the $Au_4Ni_2(PET)_8$ nanocluster of the present disclosure was very useful as the catalyst for carbon dioxide conversion reaction.

As described above, although the present disclosure has been described by specific matters such as detailed components, exemplary embodiments, they have been provided only for assisting in the entire understanding of the present disclosure. Therefore, the present disclosure is not limited to the exemplary embodiments. Various modifications and changes may be made by those skilled in the art to which the present disclosure pertains from this description. Therefore, the spirit of the present disclosure should not be limited to these exemplary embodiments, but the claims and all of modifications equal or equivalent to the claims are intended to fall within the scope and spirit of the present disclosure.

The invention claimed is:

1. A gold-doped nickel nanocluster satisfying Formula 1 below:

[Formula 1]

$$Au_xNi_y(SR)_z$$

wherein SR is an organothiol-based ligand; x is 2 or 4, y is 2 to 4, z is 8 or 10, and x+y=5 or 6 is satisfied.

2. The gold-doped nickel nanocluster of claim 1, wherein the gold-doped nickel nanocluster is $Au_2Ni_3(SR)_8$, $Au_4Ni_2(SR)_8$ or $Au_2Ni_4(SR)_{10}$.

3. The gold-doped nickel nanocluster of claim 1, wherein, in the above Formula 1, the organothiol ligand is any one or two or more selected from (C1-C30)alkanethiol, (C6-C30)arylthiol, (C3-C30)cycloalkanethiol, (C5-C30)heteroarylthiol, (C3-C30)heterocycloalkanethiol, and (C1-C30)aryl(C1-C30)alkanethiol.

4. The gold-doped nickel nanocluster of claim 1, wherein the gold-doped nickel nanocluster is a catalyst for carbon dioxide conversion reaction.

5. A method for manufacturing a gold-doped nickel nanocluster, comprising the steps of:

step a) preparing a reaction solution by mixing a nickel precursor and a gold precursor in the presence of a solvent; and step b) adding an organothiol-based ligand compound and a reducing agent to the reaction solution to synthesize a gold-doped nickel nanocluster satisfying Formula 1 below:

[Formula 1]

$$Au_xNi_y(SR)_z$$

wherein SR is an organothiol-based ligand; x is 2 or 4, y is 2 to 4, z is 8 or 10, and x+y=5 or 6 is satisfied.

6. The method of claim 5, wherein the nickel precursor is used in 1.5 to 2.5 moles based on 1 mole of the gold precursor.

7. The method of claim 5, wherein the nickel precursor is any one or two or more selected from $Ni(NO_3)_2$, $NiCl_2$, $NiSO_4$ and $Ni(C_5H_7O_2)_2$, and the gold precursor is any one or two or more selected from $HAuCl_4$, triphenylphosphine gold (I) chloride ($AuPPh_3Cl$), $AuCl_3$, $KAuCl_4$, $Au(OH)_3$ and hydrates thereof.

8. The method of claim 5, wherein the reducing agent is one or two or more selected from triethylamine, oleylamine, carbon monoxide, and sodium borohydride.

9. An electrode for carbon dioxide conversion reaction comprising the gold-doped nickel nanocluster according to claim 1.

10. A method for converting carbon dioxide comprising reducing carbon dioxide from an aqueous solution containing carbon dioxide using the electrode for carbon dioxide conversion reaction of claim 9.

* * * * *